US006155060A

United States Patent [19]

Parkman

[11] Patent Number: 6,155,060

[45] Date of Patent: Dec. 5, 2000

[54] CONDENSATION AND FROST CONTROL SYSTEM

[75] Inventor: David Parkman, Austin, Tex.

[73] Assignee: Munters Corporation, N.Y.

[21] Appl. No.: 09/435,021

[22] Filed: Nov. 5, 1999

[51] Int. Cl.[7] ..... F25D 17/06; F25D 23/00

[52] U.S. Cl. ..... 62/94; 62/271; 62/272

[58] Field of Search ..... 62/94, 271, 272, 62/248, 282

[56] References Cited

U.S. PATENT DOCUMENTS

| | | | |
|---|---|---|---|
| D. 264,751 | 6/1982 | Smith | D23/140 |
| 4,109,484 | 8/1978 | Cunningham | 62/256 |
| 4,516,482 | 5/1985 | Smith | 62/248 X |
| 4,950,869 | 8/1990 | Mueller | 219/218 |
| 5,203,175 | 4/1993 | Farrey et al. | 62/82 |
| 5,329,781 | 7/1994 | Farrey et al. | 62/82 |
| 5,450,730 | 9/1995 | Calton et al. | 62/94 |

*Primary Examiner*—William Doerrler
*Assistant Examiner*—Chen-Wen Jiang
*Attorney, Agent, or Firm*—Fitzpatrick, Cella, Harper & Scinto

[57] ABSTRACT

A condensation and frost control system for cooler and freezer doors is disclosed which includes a desiccant dehumidifier containing a desiccant body, a blower for drawing air into the desiccant body and discharging dry air therefrom. A duct system conveys the dried dry air from the blower to predetermined locations around the side edges of the door to distributed the dry air along at least a predetermined portion of the door thereby to prevent condensation and sublimate frost and ice on the predetermined portion of the door directly from solid to gas.

10 Claims, 3 Drawing Sheets

CONDENSATION AND FROST CONTROL SYSTEM

BACKGROUND OF THE INVENTION

Field of the Invention

The present invention relates to condensation and frost control systems and more particularly to a system for use with cooler and freezer entry doors.

The increase in demand for perishable food and other sensitive products have generated large processing, storage and distribution facilities, including low temperature areas with doors opening to unconditioned areas or ambient outdoor environments. Particularly, access to these areas is by means of doors, airlocks or moisture barriers in order to prevent loss of cool air to the exterior and infiltration of warm moist air into the cooler or freezer.

The door systems used with such facilities particularly are designed to be opened easily and rapidly to limit mixture of low temperature air from the interior of the facility with high temperature high humidity air from the outside. Such doors include folding doors which are drawn laterally, swinging doors, plastic strip curtains, vertical sliding horizontal roll, or vertical roll up doors, and high-speed doors.

One problem which has been encountered with all of these doors is the condensation of water and formation of frost or fogging which occurs on the doors, frames and adjacent floors and walls. The condensation drips onto the floor where below freezing surface temperatures transform the water into ice, creating a hazardous condition for workers. Frost and ice build-up on transparent door panels or windows also obstructs vision, creating an additional safety hazard for workers while frost and ice build-up on the frames of the doors may restrict movement and damage the desired uniform barriers separating the low temperature and high temperature areas.

Present technologies for preventing condensation and frost in such applications use heaters to elevate the air temperature around the door and frame. Such systems include those which use radiant heaters mounted above the door opening. One such system is shown for example in U.S. Pat. No. 4,950,869. Other systems utilize blowers in which air is directed over a heating element before being directed onto the door such as is shown in U.S. Pat. No. 5,329,781. These systems attempt to use the warm air to evaporate condensation into vapor. The difficulty with these systems are that radiant heaters cover only a limited portion of the door and frame when mounted above the door opening, while in both systems warm air put on the doors converts frost to water which then drips onto the floor. That water then flows into the low temperature space and freezes into ice continuing to create a hazardous condition, and potentially blocking movement of the door. Moreover, because door openings vary in size, larger doors are not fully treated with either of these systems to prevent condensation of frost. When larger blowers are used to apply warm air to the doors, the warm air tends to move upwardly through convection away from the critical areas of frost build-up at the bottom of the door and on the floor. Accordingly, those prior art systems which rely on warm air have not effectively addressed the problems of condensation and frost.

It is an object of the present invention to control condensation and frost on freezer and cold storage doors.

Another object of the present invention is to control condensation and frost on cooler and freezer doors by using desiccant dehumidification to cause evaporation and sublimation of frost and prevent the appearance of liquid water.

Yet another object of the present invention is to provide a condensation and frost control system for cooler and freezer doors which is economical to manufacture and reliable in use.

SUMMARY OF THE INVENTION

In accordance with an aspect of the present invention a condensation and frost control system for cooler and freezer doors is provided which includes an air distribution duct typically mounted adjacent to the top of the doorway frame and having opposed air discharge ends adjacent to the vertical sides of the doorway. A pair of generally vertically extending air discharge ducts respectively connected to the air discharge ends of the air distribution duct have discharge air openings formed therein to distribute air laterally over the surface of the door. A desiccant dehumidification system, typically mounted above the doorway, is connected through duct work to the air distribution duct for supplying dried air thereto. The dehumidification system includes a desiccant body and means for drawing air through the desiccant body to dry it and then to supply the dry air to the distribution duct.

Preferably, air is drawn from the inside cooler or from the high humidity side of the freezer door through the dehumidification body for drying before being discharged to the air distribution ducts. The cooled and dry air thus discharged over the surface of the door tends to remove moisture vapor from the air adjacent the door. Preferably the moisture content of the dried discharge air is at an equivalent dew point temperature which is less than the surface temperature of the door and the adjacent frame, walls and floor. The discharge ducts direct a layer of air over all of the cold surfaces of the door and, if desired, over predetermined portions of the door, for example windowed areas.

The dry air system of the invention conditions and distributes low dew point air to prevent condensation of water and the formation of frost as described above. Preferably it is used with freezers or cold storage units that are used to process, store and distribute perishable food or other sensitive products. Removing the moisture from the air through desiccant dehumidification increases the vapor pressure differential at the surface of the door where the dried air is discharged (as compared by the prior art and to the use of no air control system at all) in order to rapidly evaporate condensation and sublimate frost and ice directly from a solid to a gas without the appearance of liquid. Establishing a blanket of low dew point/low vapor air across the door, frame and adjacent surfaces neutralizes the infiltration or migration of high dew point high vapor pressure air from unconditioned areas or ambient outdoor environments to the door and frame. This provides a dry air zone around all areas of the opening.

It is advantageous to use a desiccant dehumidifier in accordance with the present invention to remove the moisture from the air instead of using a refrigeration approach which condenses out the moisture by using lower air temperature. Desiccant dehumidification lowers the moisture content of the air to dew point conditions lower than refrigeration type dehumidification. In addition the desiccant dehumidification increases the air temperature some what, along with the drying. The warmer air provides the energy to evaporate or sublimate any condensed water or ice. The low vapor pressure air has the capacity to absorb the water vapor without forming any fog. The combination of warmer air at a low dew point condition provides a greater moisture removal capacity than refrigerated air that is close to saturation.

Applicant has found that it is advantageous to distribute the dry air through a horizontal header and vertical ducts with apertures directing the air down each side of the door and across the primary cold surface areas. Adjustments in air flow and distribution by varying the location of the air discharge openings in the ducts, allows precise control for any door size, temperature differential between each side of the door, and the amount of activity through the door. It has been found that using air for dehumidification drawn from the cooler side of the opening of the door is preferable with coolers. This arrangement captures any moisture leakage on the colder side and provides the best conditions to the dehumidifier for maximum moisture removable. An added benefit to taking air from the cold air side of the door and as close to the ceiling as possible would be the removal of the highest humidity air from the freezer which is most likely to condense/freeze within the freezer.

As the above and other objects and features and advantages of the present invention will be apparent from the following detailed description of an illustrative embodiment thereof which is to be read in connection with the accompanying drawings wherein:

DETAILED DESCRIPTION OF A PREFERRED EMBODIMENT

Figure 1:
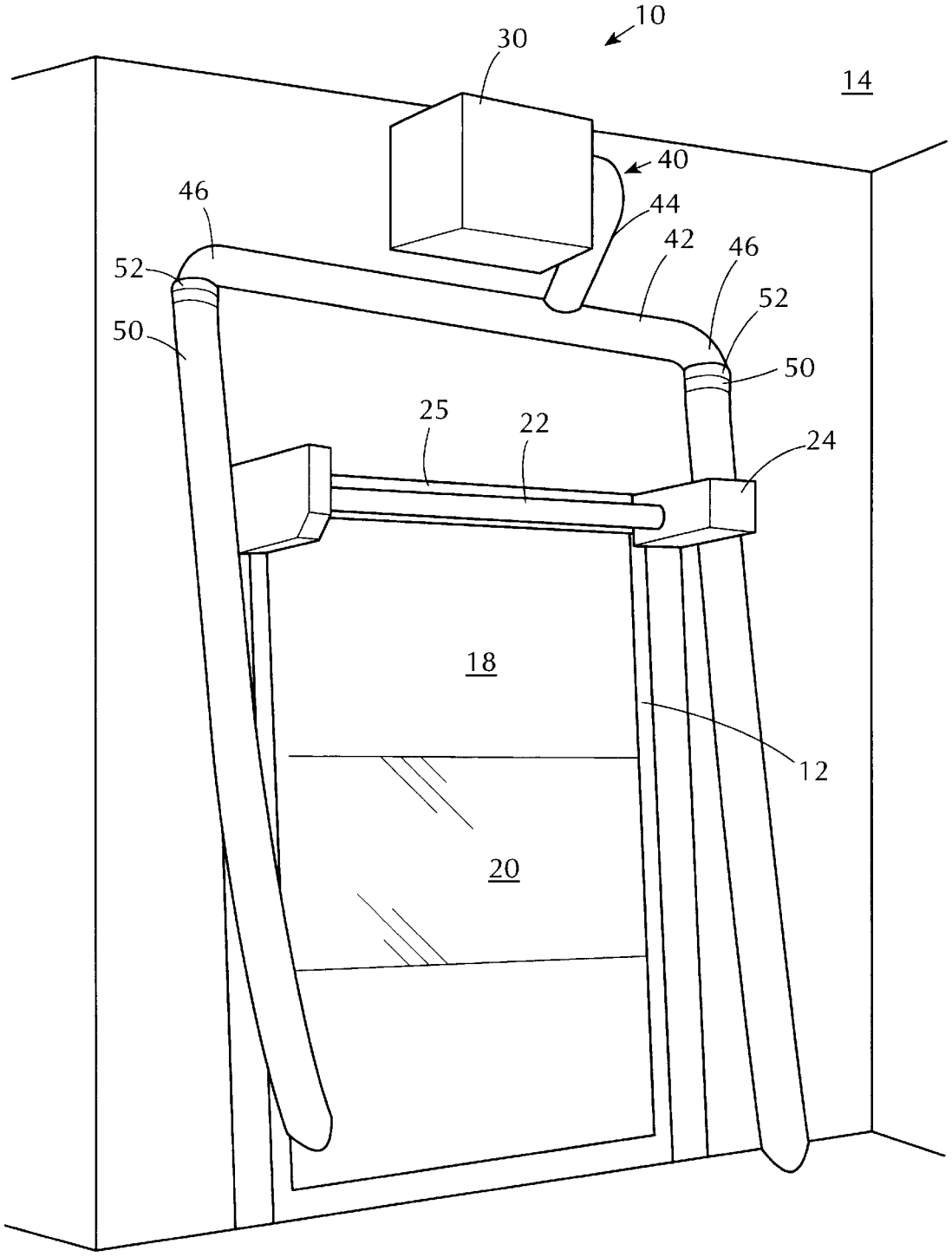
FIG. 1 is a perspective view of a cold storage room or freezer doorway utilizing a desiccant control system in accordance with the present invention.
Figure 2:
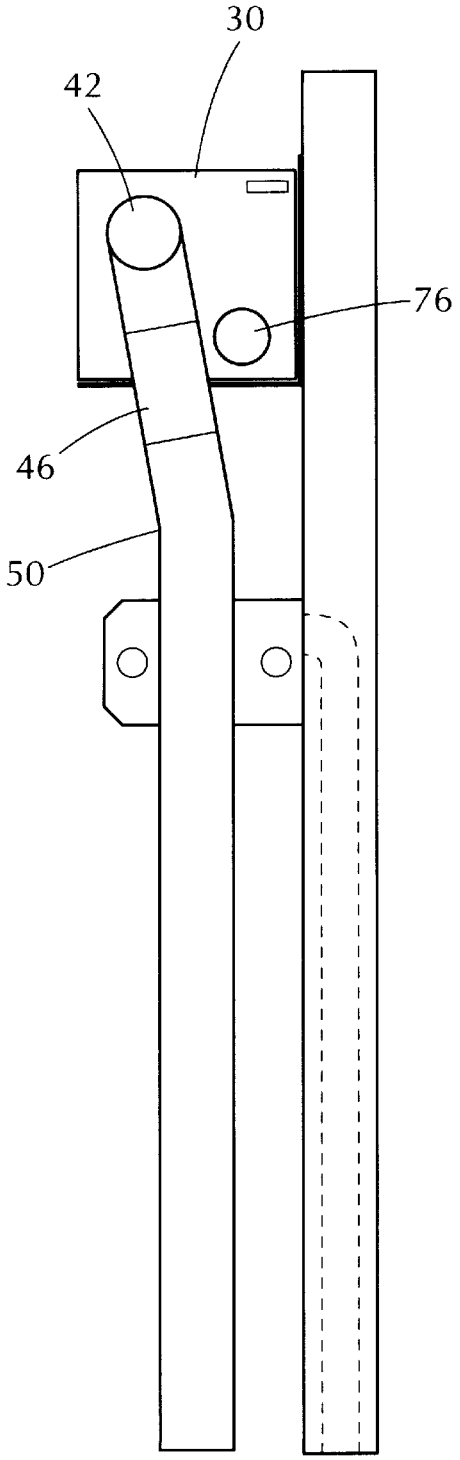
FIG. 2 is a side view of the doorway shown in FIG. 1.

Referring now to the drawings in detail, and initially to FIG. 1 thereof, a condensation and frost control system 10 constructed in accordance with the present invention is illustrated in connection with a doorway 12 formed in a wall 14 of a cold storage room or freezer 16. Doorway 12 in the illustrative embodiment contains a roll-up type door 18 of conventional construction having a window or transparent area 20 formed therein. Door 18 is mounted within a frame and is generally of conventional construction as will be understood by those skilled in the art. The door operates essentially like a conventional garage door or even window shade. The door may be rapidly raised and lowered by rolling it on a transverse roll bar 22 under the control of motor 24. As seen in the drawing, roll bar 22 is mounted on the upper edge or upper frame element 25 of the doorway.

The frost control system of the present invention includes a desiccant dehumidification system 30 which, in the illustrative embodiment of the invention, is illustrated above the top edge 25 of doorway 12. As described hereinafter unit 30 serves to dry humid air drawn from either side of the entry door 14 through a desiccant material or body contained therein and discharge it for distribution over the surface of the door. The system includes a duct work arrangement 40 which includes a transverse distribution duct 42 receiving dried air from system 30 through a discharge duct 44. The opposite ends of discharge duct 42 have air discharge ends connected to elbows 46 which direct the air generally downwardly.

Figure 4:
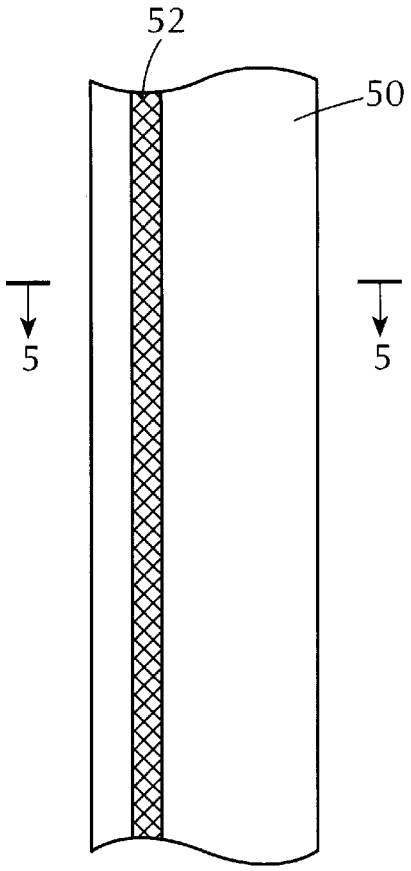
FIG. 4 is a partial vertical view of an air discharge duct used in the present invention.
Figure 5:
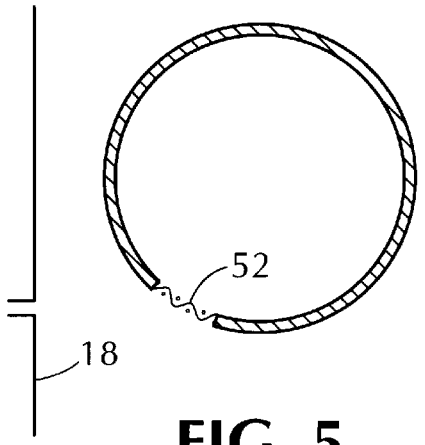
FIG. 5 is a sectional view taken along line 5—5 of FIG. 4.

Flexible fabric air discharge ducts 50 are secured at their upper ends 52 to elbows 46 in any convenient or known manner, for example by a conventional strap clamp. Air ducts 52 are of conventional known construction of the type manufactured and sold by High Quality Consultants Inc. under the trademark AIRSOCKS®. These ducts are formed of a polyester type fabric. A portion of one of the ducts is shown in somewhat greater detail in FIGS. 4 and 5. As is known in the art these ducts are formed with a mesh strip at the seam between the two ends of the material which form the cylindrical duct. This mesh seam allows air to be discharged through the slot 52 formed thereby. If desired, instead of a long vertical slot in the duct, the seam may be sealed by fabric material at selected locations along the seam in order to form separate discharge areas along the seam. Preferably fabric ducts 50 are mounted to elbows 46 so that seam 52 is directed at about a 45° angle (as shown in FIG. 5) to door 18 so that the dried air from the desiccant unit forms a blanket of air over the surface of the door.

Figure 3:
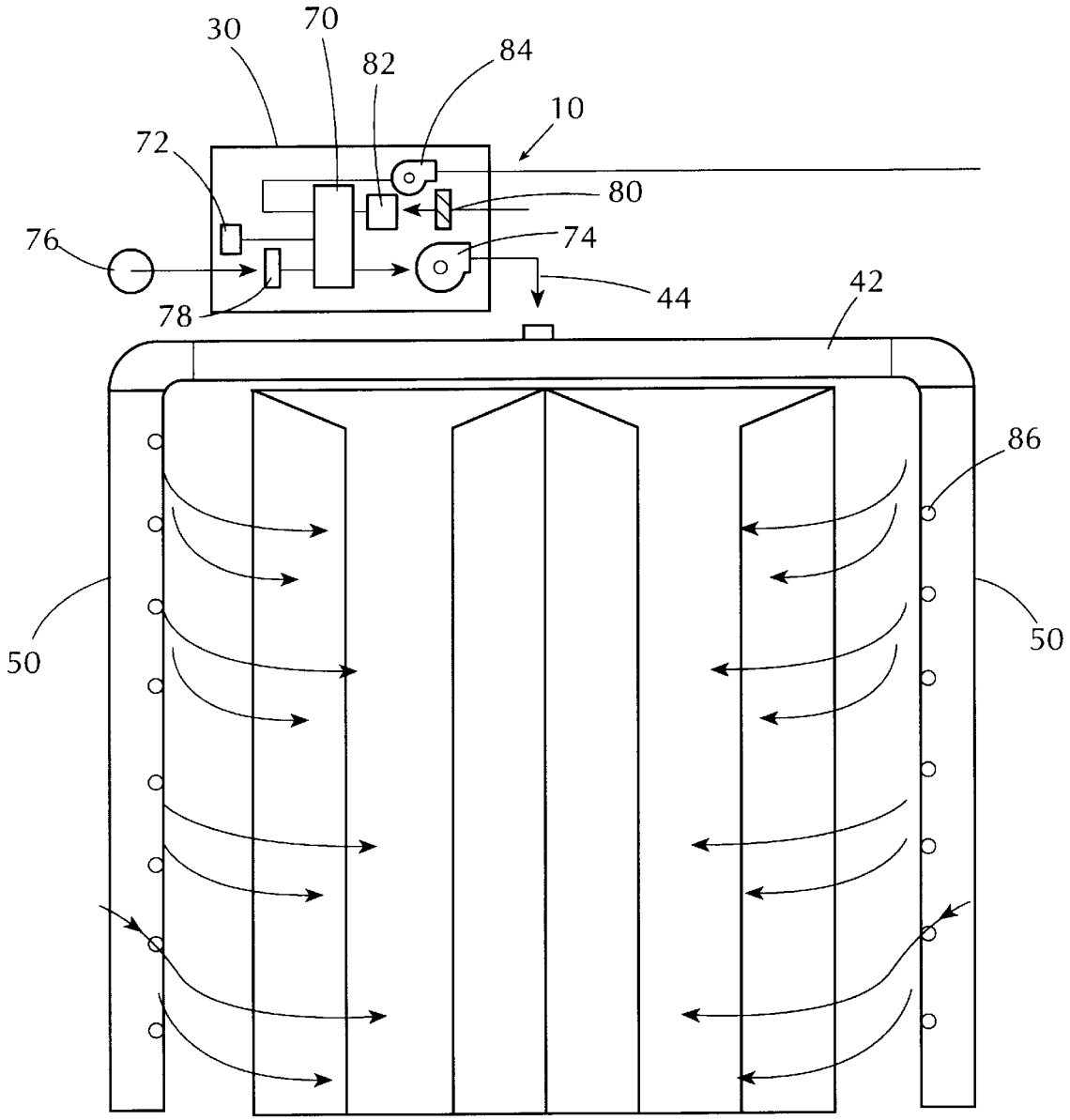
FIG. 3 is a schematic front view of a system similar to that shown in FIG. 1 using a gate like door structure.

FIG. 3 schematically illustrates another embodiment of the present invention which is essentially of the same construction. In this case the door arrangement 60 is a conventional gate type door such as shown for example in U.S. Pat. No. 4,950,869. These doors swing on vertical axes relatively rapidly to provide access to the interior of the cold storage area. The condensation and frost control system 10 illustrated in this embodiment is essentially identical to that illustrated in connection with the embodiment of FIG. 1. The dehumidification unit 30 contains a desiccant body 70 which, in the preferred embodiment of the invention is a conventional desiccant wheel. These wheels are of the type manufactured by Munter's Corporation of Fort Myers, Fla. The wheel is formed with a plurality of through passages from one face to the other and is coated with or formed of a water absorbent desiccant. The wheel is mounted to rotate at a relatively slow speed and is driven by a motor 72 in the known manner.

The dehumidification unit includes an air blower 74 which draws air from an air supply duct 76 through the desiccant wheel for discharge through the duct work 44, 42 to the fabric discharge ducts 50. When used with coolers the air supply inlet 76 is connected through the wall of the cold storage unit to draw air from a cold area in a high humidity zone (e.g., near the top of the cooler). In the case of a freezer the air supply duct 76 is positioned to draw air from the loading side or outside of the door. In the case of a freezer the air outside the door is still cold, but of higher humidity than the air inside the cooler. Alternatively, duct 76 can be arranged to allow humid air to be drawn from either area, i.e., inside, outside or from both.

The air from duct 76 passes through an air volume control damper 78 through the passage ways in the desiccant wheel in the area of the wheel below its rotational axis. As the air passes through the wheel the desiccant absorbs moisture from the air. As a result the temperature of the air is raised slightly. The dry air is then distributed as discussed above.

As is known in the art, desiccant wheels must be reactivated. This is accomplished by supplying warm reactivation air from a source (for example the external atmosphere on the warm side of the door) through an air control louver system 80 to a heater 82. The air is then passed through the desiccant wheel at the area of the wheel above its axis of rotation and discharged by blower 84 to the air stream. The passage of warm air through the desiccant wheel absorbs the warm moisture from the desiccant and allows it to be discharged to the atmosphere at a remote location.

FIG. 3 illustrates schematically that the fabric ducts 50 can have small air discharge openings 86 formed therein as described above at predetermined locations along the length of the duct.

The present invention provides the advantage of a condensation and frost control system that prevents moist air from coming in contact with cold surfaces at cooler and freezer entries. The control system incorporates a conventional dehumidifier, duct distribution header and vertical fabric ducting all of which are individually commercially available to air system installers. The combination, however, is unique in the context of applying dehumidified cool air directly to cooler and freezer doors with this structure. Dry low dew point air is discharged through light weight relatively inexpensive ducts at predetermined locations on the surface of the door where it evaporates condensation, moisture and sublimates frost directly into vapor gas so that no ice or frost melts and flows to the floor where it can refreeze.

Although illustrative embodiments of the present invention have been described herein with reference to the accompanying drawings, it is to be understood that the invention is not limited to those precise embodiments and that various changes and modifications may be effected therein to those skilled in the art without departing from the scope or spirit of this invention.

What is claimed is:

1. A condensation and frost control system for cooler and freezer doors having a top and spaced vertical sides, said system comprising a desiccant dehumidifier including a desiccant body, a blower for drawing humid air into the desiccant body of the dehumidifier and discharging dry air therefrom and means for reactivating the desiccant body; and a duct system for conveying dry air discharged by the blower from the desiccant body, said duct system including duct sections adapted to be located at predetermined positions along the sides and/or top of the door and having air discharge openings formed therein positioned to direct dry air at least along a predetermined portion of the door.

2. A system as defined in claim 1 wherein said desiccant body is a rotatable desiccant wheel.

3. A system as defined in claim 2 wherein said duct sections are fabric ducts having said air discharge opening formed therein.

4. A system as defined in claim 3 including an air supply duct in communication between either the interior or exterior of the cooler or freezer and said desiccant body whereby humid air is supplied to the desiccant body.

5. A system as defined in claim 4 wherein said desiccant body is a rotatable desiccant wheel.

6. A condensation and frost control system for cooler and freezer doors mounted in a doorway having a frame including a top and two spaced vertical sides, said system including an air distribution duct mounted adjacent the top of the doorway frame and having opposed air discharge ends adjacent said vertical sides, a pair of generally vertically extending air discharge ducts respectively connected to the air discharge ends of the air distribution duct and having air discharge opens for directing air laterally over the surface of the door; and a desiccant dehumidification system for supplying dried air to the air distribution and discharge ducts including a desiccant body, means for drawing air through the desiccant body to dry it and then supply the dry air to the air distribution duct and means for reactivating the desiccant body.

7. A system as defined in claim 6 wherein said desiccant body is a rotatable desiccant wheel.

8. A system as defined in claim 7 wherein said air discharge opening are vertically elongated slots formed in said fabric ducts.

9. A method for controlling frost and condensation on a freezer door comprising the steps of drawing air from near the door into a desiccant dehumidifier, drying the air in the dehumidifier to a moisture content at a dew point temperature less than the surface of the door and discharging the dried air toward the door to evaporate condensation and sublimate frost and ice directly from a solid to gas.

10. A method as defined in claim 9 wherein said step of discharging the air toward the door comprises distributing the dried air in ducts vertically along the sides of the door and discharging the air from discharge openings in the ducts at a horizontal angle to the door to form a blanket of dry air over at least a predetermined portion of the door.

* * * * *